US006973687B1

(12) United States Patent
Tseng

(10) Patent No.: US 6,973,687 B1
(45) Date of Patent: Dec. 13, 2005

(54) FOLDABLE STAND FOR A HAMMOCK

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/889,775

(22) Filed: Jul. 13, 2004

(51) Int. Cl.[7] ..... A45F 3/22
(52) U.S. Cl. ..... 5/127; 5/129; 5/122
(58) Field of Search ..... 5/120, 122, 127, 5/129

(56) References Cited

U.S. PATENT DOCUMENTS 531,727 A * 1/1895 Keegam, Sr. et al. ..... 5/129
679,963 A * 8/1901 Hayward ..... 5/129
944,784 A * 12/1909 Hand ..... 5/129
6,748,616 B1 * 6/2004 Tseng ..... 5/710

* cited by examiner

*Primary Examiner*—Michael Trettel
(74) *Attorney, Agent, or Firm*—Ladas & Parry LLP

(57) ABSTRACT

A foldable stand, which is for suspending a hammock above the ground, includes a base unit and a supporting unit. The base unit includes an elongate base, and a pair of lateral members, each of which is coupled pivotally to the elongate base. The supporting unit includes an arcuate rod that is mounted on the elongate base and that is capable of supporting the hammock.

15 Claims, 5 Drawing Sheets

FOLDABLE STAND FOR A HAMMOCK

BACKGROUND OF THE INVENTION

1. Field of the Invention

The invention relates to a hammock stand, more particularly to a foldable hammock stand.

2. Description of the Related Art

Typically, hammocks are suspended above the ground between trees, posts, and other relatively stable supporting structures. However, these supporting structures do not normally exist in areas which are most desirable for the use of a hammock. A conventional hammock stand has been proposed to alleviate this drawback.

Although the conventional hammock stand achieves its intended purpose, since the conventional hammock stand includes numerous parts, this arises in inconvenience on the part of the user during assembling and disassembling. Furthermore, these parts are easily misplaced during disassembly and storage.

SUMMARY OF THE INVENTION

Therefore, the object of the present invention is to provide a foldable hammock stand that is capable of overcoming the aforesaid drawbacks of the prior art.

According to the present invention, a foldable stand, which is adapted for suspending a hammock above the ground, includes a base unit and a supporting unit. The base unit includes an elongate base and a pair of lateral members. The elongate base has opposite front and rear walls, and a top wall that interconnects the front and rear walls. Each of the front, rear, and top walls has opposite left and right end portions. Each of the lateral members is coupled pivotally to the elongate base at a position between the left and right end portions of a respective one of the front and rear walls. Each of the lateral members is pivotable relative to the elongate base to an unfolded position, where each of the lateral members is disposed generally transverse to the respective one of the front and rear walls. The supporting unit is mounted on the elongate base, and is adapted to support the hammock.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
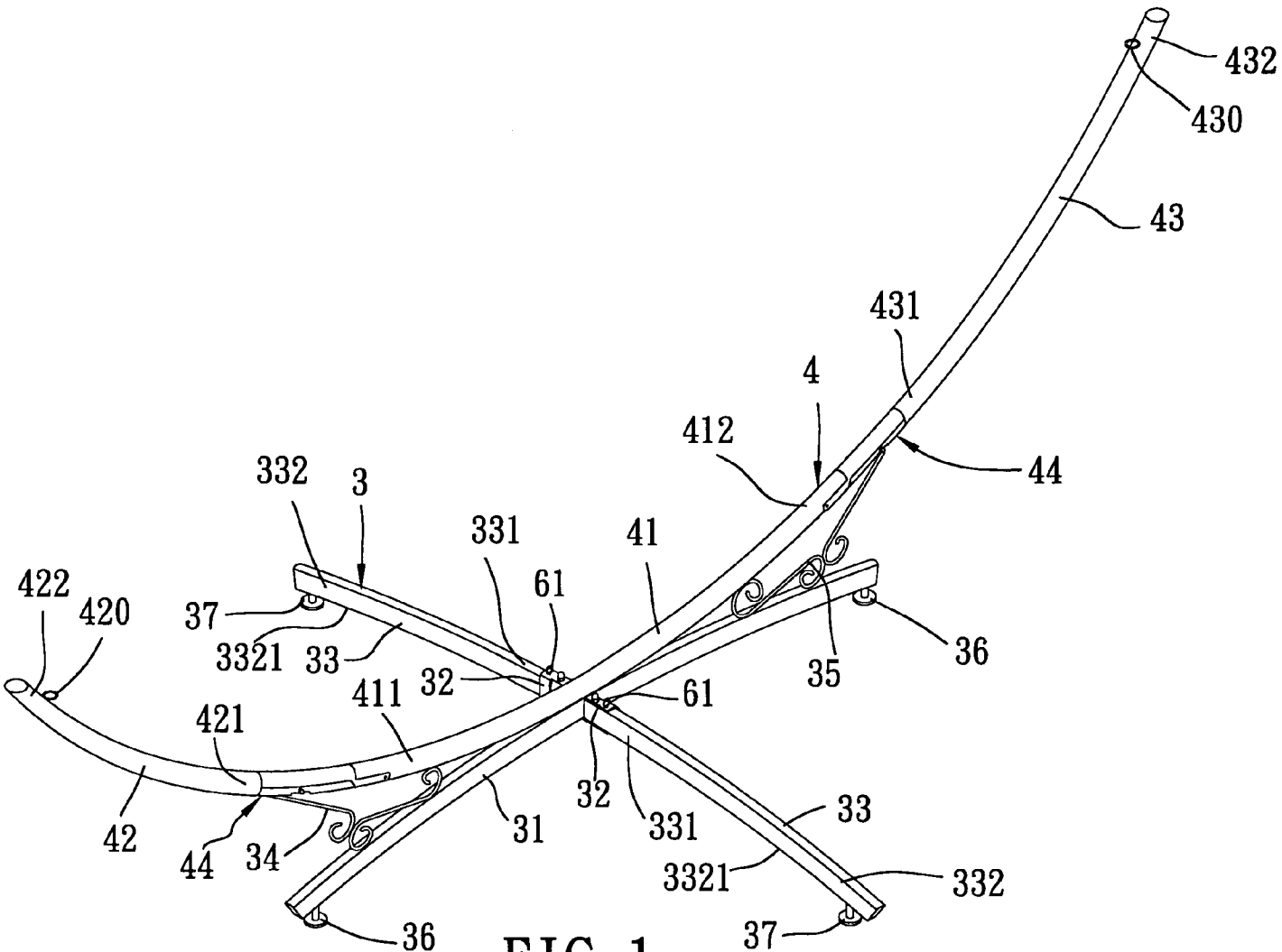
FIG. 1 is a perspective view of the preferred embodiment of a foldable stand according to the present invention.
Figure 2:
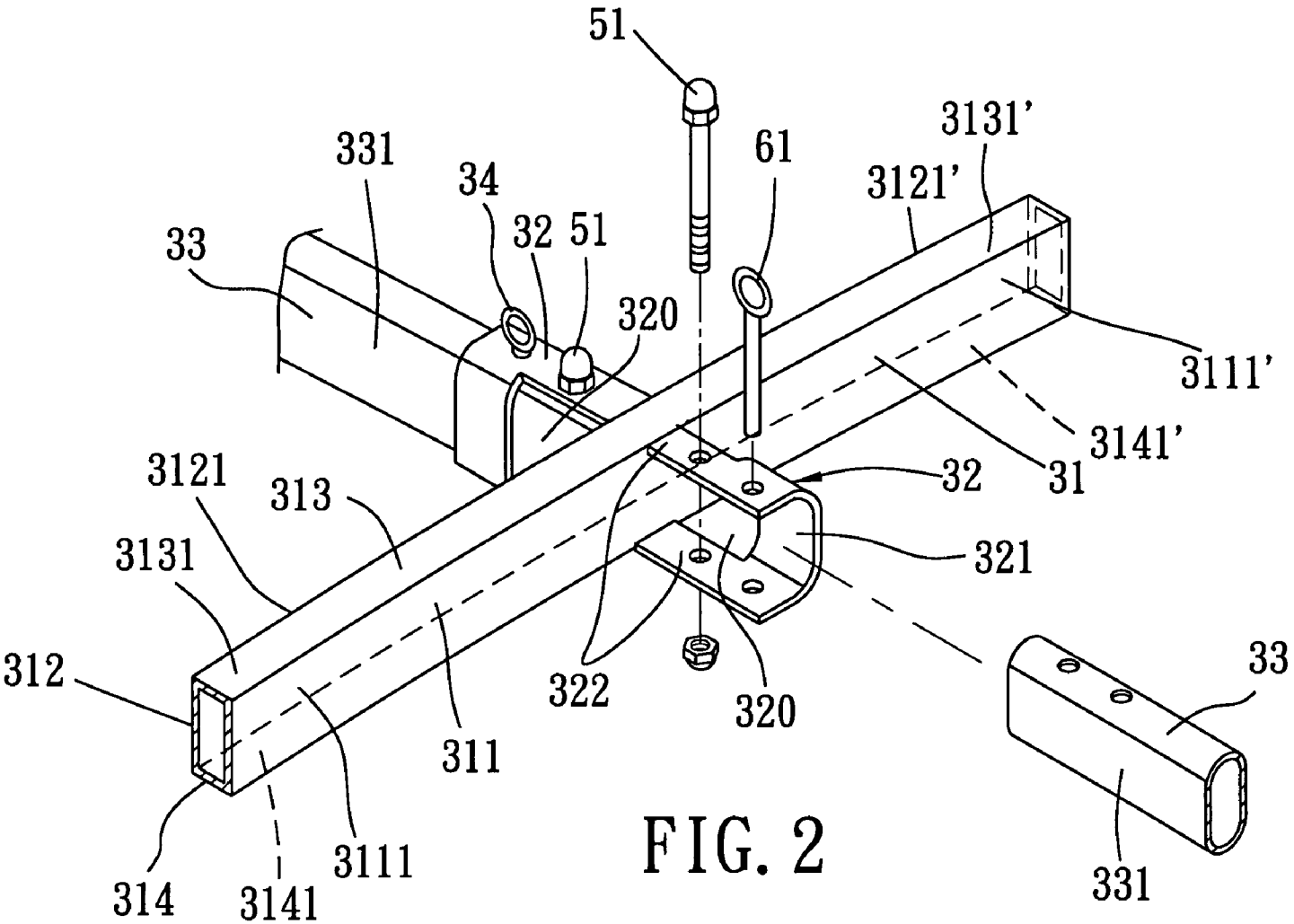
FIG. 2 is a fragmentary exploded perspective view to illustrate a base unit of the preferred embodiment.

Referring to FIGS. 1 and 2, the preferred embodiment of a foldable stand according to this invention is shown to include a base unit 3 and a supporting unit 4.

The foldable stand of this embodiment is adapted to suspend a hammock (not shown) above the ground (not shown).

The base unit 3 includes an elongate base 31 and a pair of lateral members 33. The elongate base 31 has opposite front and rear walls 311, 312, a top wall 313 that interconnects the front and rear walls 311, 312, and a bottom wall 314 that is opposite to the top wall 313 and that interconnects the front and rear walls 311, 312. Each of the front wall 311, the rear wall 312, the top wall 313, and the bottom wall 314 has opposite left and right end portions 3111, 3121, 3131, 3141, 3111', 3121', 3131', 3141'. Each of the lateral members 33 is coupled pivotally to the elongate base 31 at a position between the left and right end portions 3111, 3111', 3121, 3121' of a respective one of the front and rear walls 311, 312. In particular, the base unit 3 further includes a pair of connecting brackets 32. Each of the connecting brackets 32 has a first end portion 321, and a second end portion 322 opposite to the first end portion 321 of a respective one of the connecting brackets 32. The second end portion 322 of each of the connecting brackets 32 has a distal end that is distal from the first end portion 321 of the respective one of the connecting brackets 32 and that is connected securely to the elongate base 31 at a position between the left and right end portions 3111, 3111', 3121, 3121' of a respective one of the front and rear walls 311, 312. The first end portion 321 of each of the connecting brackets 32 has a U-shaped cross-section, and includes a pair of parallel arms and a cross arm. The second end portion 322 of each of the connecting brackets 32 includes two parallel arms that extend respectively from the parallel arms of the first end portion 321 of the respective one of the connecting brackets 32. Each of the lateral members 33 has a pivot end portion 331 that is connected pivotally to the parallel arms of the second end portion 322 of a respective one of the connecting brackets 32, and a free end portion 332 opposite to the pivot end portion 331 of a respective one of the lateral members 33. The foldable stand further includes a first pivot unit that includes a pair of first pivot pins 51. The pivot end portion 331 of each of the lateral members 33 is pivoted to the second end portion 322 of the respective one of the connecting brackets 32 through a respective one of the first pivot pins 51.

In this embodiment, each of the lateral members 33 is pivotable relative to the elongate base 31 between a first unfolded position, where each of the lateral members 33 is disposed generally transverse to the respective one of the front and rear walls 311, 312, and a first folded position, where each of the lateral members 33 is disposed juxtaposed to a respective one of the left end portion 3111 of the front wall 311 and the right end portion 3121' of the rear wall 312. In an alternative embodiment, each of the lateral members 33 is pivotable relative to the elongate base 31 to the first folded position, where each of the lateral members 33 is disposed juxtaposed to a respective one of the right end portion 3111' of the front wall 311 and the left end portion 3121 of the rear wall 312. In yet another embodiment, each of the lateral members 33 is pivotable relative to the elongate base 31 to the first folded position, where each of the lateral members 33 is disposed juxtaposed to the left end portion 3111, 3121 of the respective one of the front and rear walls 311, 312. In still another embodiment, each of the lateral members 33 is pivotable relative to the elongate base 31 to the first folded position, where each of the lateral members 33 is disposed juxtaposed to the right end portion 3111', 3121' of the respective one of the front and rear walls 311, 312.

It is noted that the second end portion 322 of each of the connecting brackets 32 is formed with a hole 320 between the arms of the second end portion 322 of the respective one of the connecting brackets 32. The pivot end portion 331 of each of the lateral members 33 extends through the hole 320 in the second end portion 322 of the respective one of the connecting brackets 32 when the lateral members 33 are disposed at the first folded positions.

The foldable stand further includes a retaining unit that fastens releasably each of the lateral members 33 to a respective one of the connecting brackets 32 to retain the lateral members 33 at the first unfolded positions. In this embodiment, the retaining unit includes a pair of locking pins 61, each of which extends removably through the first end portion 321 of the respective one of the connecting brackets 32 and the pivot end portion 331 of the respective one of the lateral members 33.

The supporting unit 4 includes an arcuate rod. In this embodiment, the arcuate rod includes a middle curved rod part 41, and left and right curved rod parts 42, 43. The middle curved rod part 41 is mounted on the top wall 313 of the elongate base 31, and has opposite first and second end portions 411, 412. The left curved rod part 42 has a pivot end portion 421 coupled pivotally to the first end portion 411 of the middle curved rod part 41, and a free end portion 422 opposite to the first end portion 421 of the left curved rod part 42. The right curved rod part 43 has a pivot end portion 431 coupled pivotally to the second end portion 412 of the middle curved rod part 41, and a free end portion 432 opposite to the first end portion 431 of the right curved rod part 43. In an alternative embodiment, the left and right curved rod parts 42, 43 extend integrally and respectively from the first and second end portions 411, 412 of the middle curved rod part 41.

Figure 3:
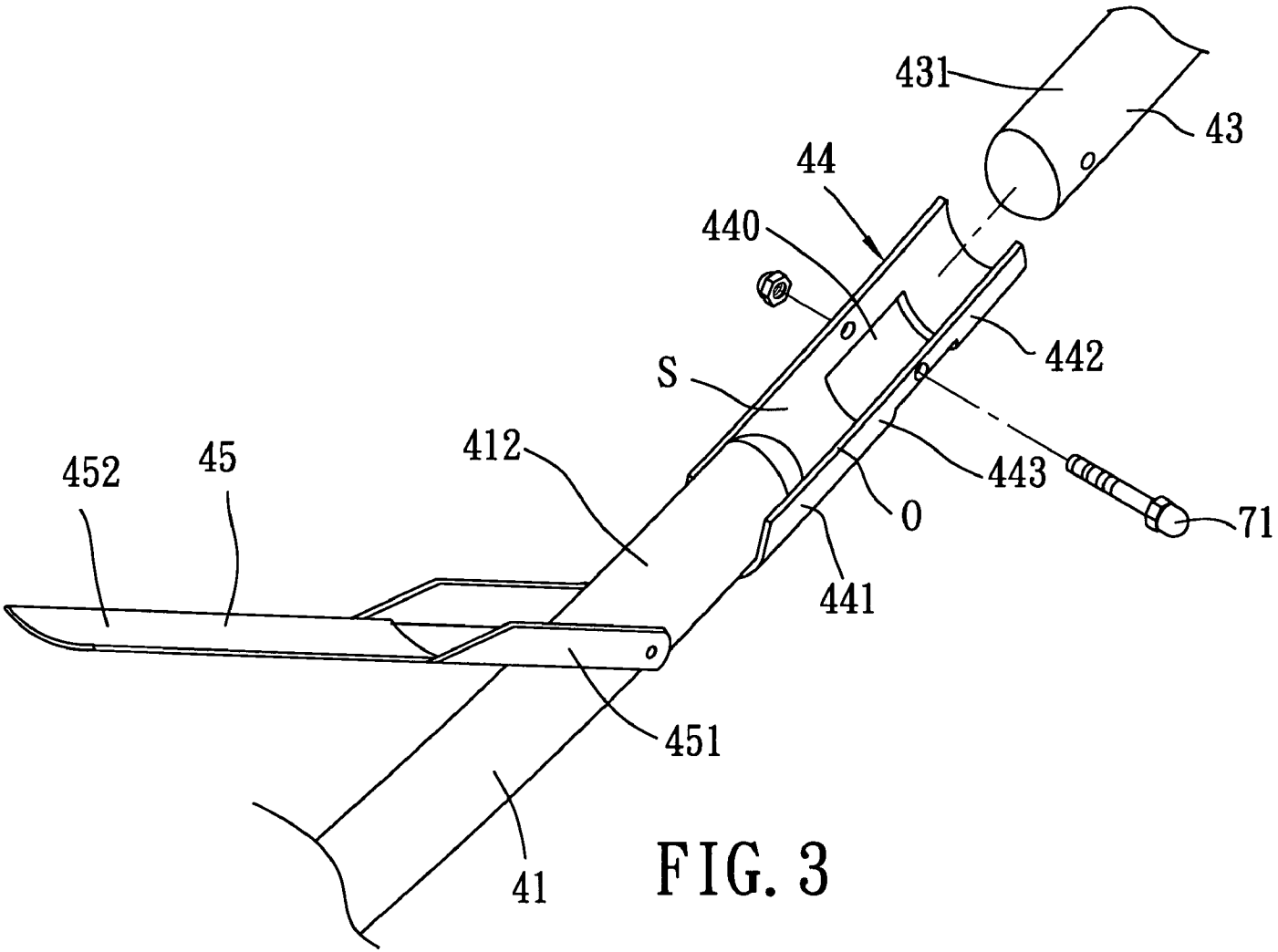
FIGS. 3 and 4 are fragmentary exploded perspective views to illustrate supporting brackets of the preferred embodiment.
Figure 4:
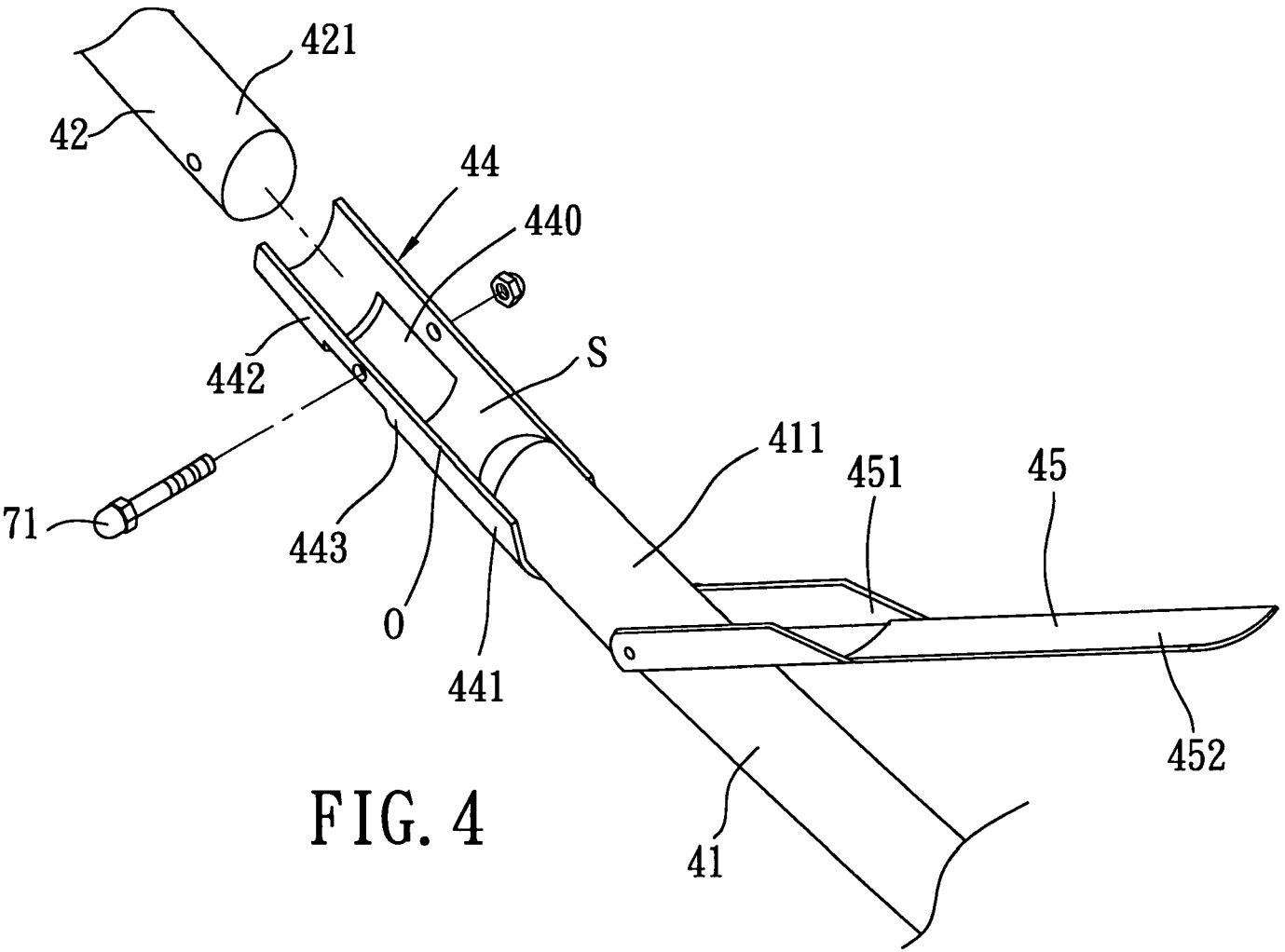

With additional reference to FIGS. 3 and 4, the supporting unit 4 further includes a pair of supporting brackets 44. In this embodiment, each of the supporting brackets 44 defines a receiving space (S), and an open end (O) that is in spatial communication with the receiving space (S) and that opens upwardly. Furthermore, each of the supporting brackets 44 has opposite first and second end portions 441, 442, and an intermediate portion 443 disposed between the first and second end portions 441, 442 of a respective one of the supporting brackets 44. Each of the first and second end portions 411, 412 of the middle curved rod part 41 extends into the receiving space (S) in a respective one of the supporting brackets 44. The first end portion 441 of each of the supporting brackets 44 is connected securely to the respective one of the first and second end portions 411, 413 of the middle curved rod part 41. The pivot end portion 421, 431 of each of the left and right curved rod parts 42, 43 extends into the receiving space (S) in a respective one of the supporting brackets 44. The second end portion 442 of each of the supporting brackets 44 is connected pivotally to the pivot end portion 421, 431 of the respective one of the left and right curved rod parts 42, 43.

The foldable stand further includes a second pivot unit that includes a pair of second pivot pins 71. The pivot end portion 421, 431 of each of the left and right curved rod parts 42, 43 is pivoted to the second end portion 442 of the respective one of the supporting brackets 44 through a respective one of the second pivot pins 71.

Figure 5:
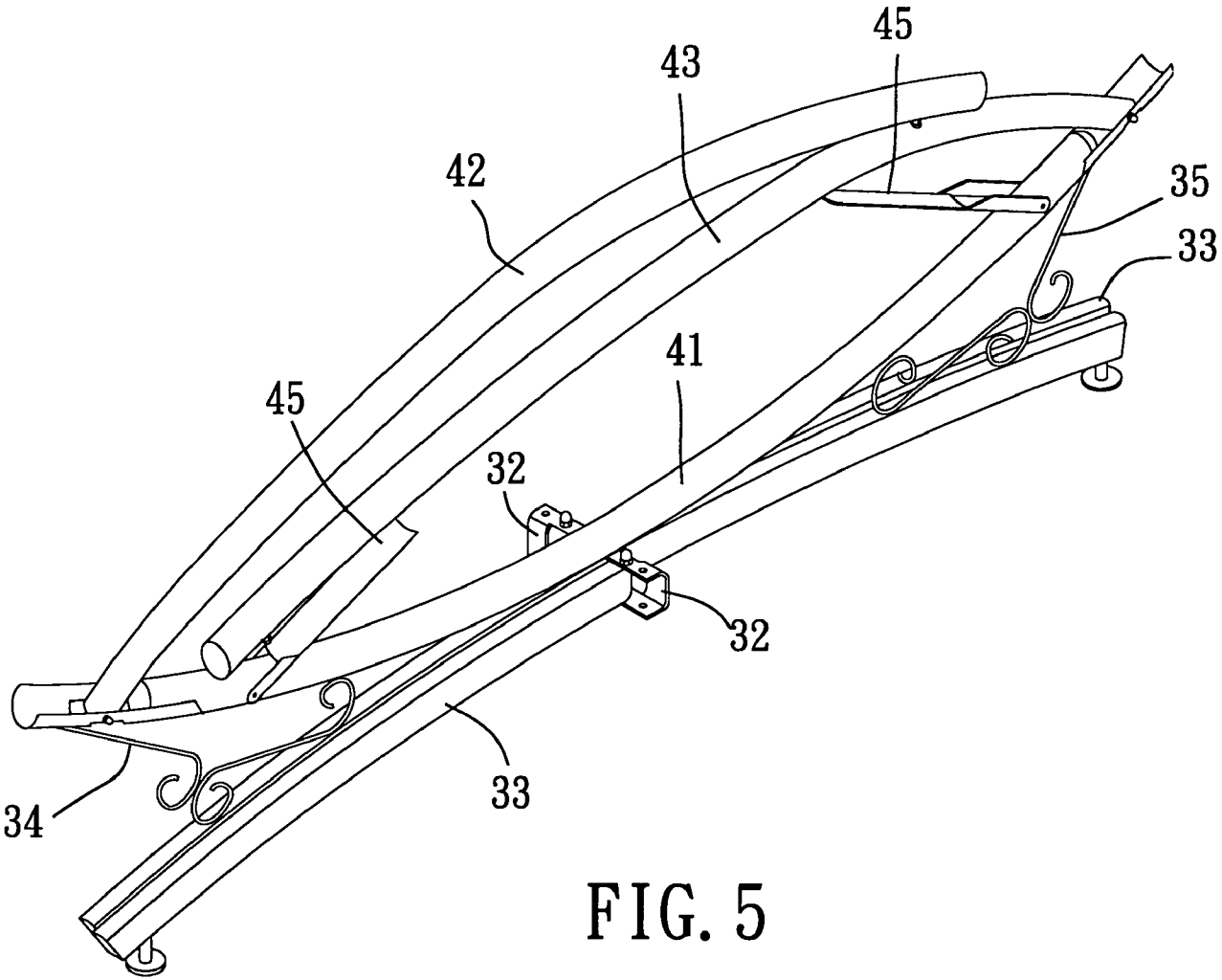
FIG. 5 is a perspective view to illustrate a state where lateral members and an arcuate rod of the preferred embodiment are all disposed at a folded position.

In this embodiment, the arcuate rod is capable of being disposed between a second unfolded position, where the arcuate rod extends curvedly and upwardly from the top wall 313 of the elongate base 31 at a position between the left and right end portions 3131, 3131' of the top wall 313, as best shown in FIG. 1, and a second folded position, where said left and right curved rod parts 42, 43 are disposed juxtaposed to the middle curved rod part 41, as best shown in FIG. 5.

It is noted that the left, middle, and right curved rod parts 42, 41, 43 cooperatively form an arch when the arcuate rod is disposed at the second unfolded position, as best shown in FIG. 1.

It is also noted that the left and right curved rod parts 42, 43 are adapted to support the hammock when the arcuate rod is disposed at the second unfolded position. In particular, as best shown in FIG. 1, the free end portion 422, 432 of each of the left and right curved rod parts 42, 43 is provided with a loop 420, 430 that is fastened to a respective one of first and second ends of the hammock.

It is further noted that the intermediate portion 443 of each of the supporting brackets 44 defines a through hole 440 that is in spatial communication with the receiving space (S). The pivot end portion 421, 431 of each of the left and right curved rod parts 42, 43 extends through the through hole 440 in the intermediate portion 443 of the respective one of the supporting brackets 44 when the arcuate rod is disposed at the second folded position.

As best shown in FIGS. 3 and 4, the supporting unit 4 further includes a pair of covers 45, each of which has a first end portion 451 that is connected pivotably to a respective one of the first and second ends 411, 412 of the middle curved rod part 41, and a second end portion 452 that extends from the first end portion 451 of a respective one of the covers 45. Each of the covers 45 is pivotable relative to the middle curved rod part 41 between a covering position, where the second end portion 452 of each of the covers 45 covers the open end (O) of a respective one of the supporting brackets 44 when the arcuate rod is disposed at the second unfolded position, and an uncovering position, where the second end portion 452 of each of the covers 45 uncovers the open end (O) of the respective one of the supporting brackets 44 when the arcuate rod is disposed at the second folded position.

The base unit 3 further includes a first reinforcing member 34 connected to the first end portion 411 of the middle curved rod part 41 of the arcuate rod and the left end portion 3131 of the top wall 313 of the elongate base 31, and a second reinforcing member 35 connected to the second end portion 412 of the middle curved rod part 41 of the arcuate rod and the right end portion 3131' of the top wall 313 of the elongate base 31.

The base unit 3 further includes a pair of first level-adjusting members, each of which includes a screw rod 36 that threadedly engages a respective one of the left and right end portions 3141, 3141' of the bottom wall 314 of the elongate base 31. The free end portion 332 of each of the lateral members 33 has a bottom wall 3321. The base unit 3 further includes a pair of second level-adjusting members, each of which includes a screw rod 37 that threadedly engages the bottom wall 3321 of the free end portion 332 of a respective one of the lateral members 33.

Referring to FIG. 5, when it is desired to fold the foldable stand, firstly, the covers 45 are disposed at the uncovering positions. Secondly, each of the locking pins 61 (see FIG. 2) is removed. Thirdly, the lateral members 33 are disposed at the first folded position. Finally, the left and right curved rod parts 42, 43 are disposed at the second folded position.

It has thus been shown that the foldable stand of this invention includes a base unit 3 and an arcuate rod. The base unit 3 includes an elongate base 31, and a pair of lateral members 33, each of which is coupled pivotally to the elongate base 31. The arcuate rod includes a middle curved rod part 41 that is mounted on the elongate base 31 and that has opposite first and second end portions 411, 412, and left and right curved rod parts 42, 43 coupled pivotally and respectively to the first and second end portions 411, 412 of the middle curved rod part 41. As such, the foldable stand can be easily and conveniently folded to facilitate transport or storage.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable stand adapted for suspending a hammock above the ground, said foldable stand comprising:

a base unit including:

an elongate base that has opposite front and rear walls, and a top wall that interconnects said front and rear walls, each of said front, rear, and top walls having opposite left and right end portions, and a pair of lateral members, each of which is coupled pivotally to said elongate base at a position between said left and right end portions of a respective one of said front and rear walls, each of said lateral members being pivotable relative to said elongate base to a first unfolded position, where each of said lateral members is disposed generally transverse to the respective one of said front and rear walls; and a supporting unit mounted on said elongate base, and adapted to support the hammock;

wherein said supporting unit includes an arcuate rod, said arcuate rod being extendible to a second unfolded position, where said arcuate rod extends curvedly and upwardly from said top wall of said elongate base at a position between said left and right end portions of said top wall, said arcuate rod being adapted to support the hammock when disposed at the second unfolded position.

2. The foldable stand as claimed in claim 1, wherein said base unit further includes a pair of connecting brackets, each of said connecting brackets being connected securely to said elongate base at a position between said left and right end portions of a respective one of said front and rear walls, each of said lateral members being connected pivotally to a respective one of said connecting brackets.

3. The foldable stand as claimed in claim 2, wherein each of said connecting brackets has:

a first end portion that is U-shaped, and that includes a pair of parallel arms and a cross arm, and a second end portion that is connected securely to said elongate base, that is connected pivotally to a respective one of said lateral members, and that includes a pair of parallel arms extending respectively from said arms of said first end portion.

4. The foldable stand as claimed in claim 3, further comprising a retaining unit that fastens releasably each of said lateral members to the respective one of said connecting brackets to retain said lateral members at the first unfolded positions.

5. The foldable stand as claimed in claim 4, wherein said retaining unit includes a pair of locking pins, each of which extends removably through the respective one of said connecting brackets and the respective one of said lateral members.

6. The foldable stand as claimed in claim 1, wherein each of said lateral members is further pivotable relative to said elongate base to a first folded position, where each of said lateral members is disposed juxtaposed to the respective one of said front and rear walls.

7. The foldable stand as claimed in claim 1, wherein said arcuate rod includes a middle curved rod part mounted on said top wall of said elongate base and having opposite first and second end portions, a left curved rod part coupled pivotally to said first end portion of said middle curved rod part, and a right curved rod part coupled pivotally to said second end portion of said middle curved rod part, said left, middle, and right curved rod parts cooperatively forming an arch when said arcuate rod is disposed at the second unfolded position, said left and right curved rod parts being adapted to support the hammock when said arcuate rod is at the second unfolded position.

8. The foldable stand as claimed in claim 7, wherein said supporting unit further includes a pair of supporting brackets connected securely and respectively to said first and second end portions of said middle curved rod part, and connected pivotally and respectively to said left and right curved rod parts.

9. The foldable stand as claimed in claim 8, wherein each of said supporting brackets defines a receiving space for extension of a respective one of said left and right curved rod parts therein, and has an open end that is in spatial communication with said receiving space and that opens upwardly, said supporting unit further including a pair of covers, each of which has a first end portion that is connected pivotably to a respective one of said first and second end portions of said middle curved rod part, and a second end portion that extends from said first end portion of a respective one of said cover and that covers said open end of a respective one of said supporting brackets when said arcuate rod is disposed at the second unfolded position.

10. The foldable stand as claimed in claim 7, wherein said base unit further includes a first reinforcing member connected to said middle curved rod part of said arcuate rod and said left end portion of said top wall of said elongate base, and a second reinforcing member connected to said middle curved rod part of said arcuate rod and said right end portion of said top wall of said elongate base.

11. The foldable stand as claimed in claim 7, wherein said arcuate rod is foldable from said second unfolded position to a second folded position, where said left and right curved rod parts are disposed juxtaposed to said middle curved rod part.

12. A foldable stand adapted for suspending a hammock above the ground, said foldable stand comprising;

a base unit including:

an elongate base that has opposite front and rear walls, and a top wall that interconnects said front and rear walls, each of said front, rear, and top walls having opposite left and right end portions, a pair of lateral members, each of which is coupled pivotally to said elongate base at a position between said left and right end portions of a respective one of said front and rear walls, each of said lateral members being pivotable relative to said elongate base to a first unfolded position, where each of said lateral members is disposed generally transverse to the respective one of said front and rear walls, and a pair of connecting brackets, each of said connecting brackets having a first end portion that is U-shaped, and that includes a pair of parallel arms and a cross arm, and a second end portion that is connected securely to said elongate base at a position between said left and right end portions of a respective one of said front and rear walls, that is connected pivotally to a respective one of said lateral members, and that includes a pair of parallel arms extending respectively from said arms of said first end portion; and a supporting unit mounted on said elongate base and adapted to support the hammock.

13. The foldable stand as claimed in claim 12, further comprising a retaining unit that fastens releasably each of said lateral members to the respective one of said connecting brackets to retain said lateral members at the first unfolded positions.

14. The foldable stand as claimed in claim 13, wherein said retaining unit includes a pair of locking pins, each of which extends removably through the respective one of said connecting brackets and the respective one of said lateral members.

15. A foldable stand adapted for suspending a hammock above the ground, said foldable stand comprising:

a base unit including:

an elongate base that has opposite front and rear walls, a top wall that interconnects said front and rear walls, and a bottom wall that is opposite to said top wall, that interconnects said front and rear walls, and that has left and right end portions, each of said front, rear, top, and bottom walls having opposite left and right end portions, a pair of lateral members, each of which has a pivot end portion that is coupled pivotally to said elongate base at a position between said left and right end portions of respective one of said front and rear walls, and a free end portion that is opposite to said pivot end portion and that has a bottom wall, each of said lateral members being pivotable relative to said elongate base to a first unfolded position, where each of said lateral members is disposed generally transverse to the respective one of said front and rear walls, a pair of first level-adjusting members, each of which includes a screw rod that threadedly engages a respective one of said left and right end portions of said bottom wall of said elongate base, and a pair of second level-adjusting members, each of which includes a screw rod that threadedly engages said bottom wall of said free end portion of a respective one of said lateral members; and a supporting unit mounted on said elongate base and adapted to support the hammock.

* * * * *